US005197906A

United States Patent [19]

Watanabe et al.

[11] Patent Number: 5,197,906

[45] Date of Patent: Mar. 30, 1993

[54] RESILIENT TERMINAL WITH BUCKLING PREVENTION MECHANISM

[75] Inventors: Mitsugu Watanabe; Nozomi Kawasaki; Masaaki Sugiyama; Yoshihisa Natsume, all of Kosai, Japan

[73] Assignee: Yazaki Corporation, Tokyo, Japan

[21] Appl. No.: 817,506

[22] Filed: Mar. 13, 1992

Related U.S. Application Data

[60] Division of Ser. No. 698,346, May 7, 1991, Pat. No. 5,122,083, which is a continuation of Ser. No. 460,498, Jan. 3, 1990, abandoned.

[30] Foreign Application Priority Data

Jan. 25, 1989 [JP] Japan ..... 1-6399
Nov. 10, 1989 [JP] Japan ..... 1-130553

[51] Int. Cl.[5] ..... H01R 13/11
[52] U.S. Cl. ..... 439/787; 439/850

[58] Field of Search ..... 439/787, 845, 849, 850, 439/723, 724

[56] References Cited

U.S. PATENT DOCUMENTS 2,514,336 7/1950 Paige ..... 439/787
4,221,456 9/1980 Cairns et al. ..... 439/787
4,472,017 9/1984 Sian ..... 439/850

*Primary Examiner*—Gary F. Paumen
*Attorney, Agent, or Firm*—Armstrong, Westerman, Hattori, McLeland & Naughton

[57] ABSTRACT

A resilient terminal with a buckling prevention mechanism has a pair of electric contact portions that are interconnected through a flexible joint portion. The flexible joint portion is protected against buckling because an excess bending of the joint portion is blocked by an abutment portion on one of the electric contact portions abutting against the other electric contact portion.

2 Claims, 4 Drawing Sheets

RESILIENT TERMINAL WITH BUCKLING PREVENTION MECHANISM

This application is a division of application Ser. No. 698,346 filed May 7, 1991 now U.S. Pat. No. 5,122,083 which was a continuation of application Ser. No. 460,498, filed on Jan. 3, 1990 now abandoned.

BACKGROUND OF THE INVENTION

1. Field of the Invention

The present invention relate to a resilient terminal with a buckling prevention mechanism, which has a pair of electric contact portions and which prevents faulty engagement and deformation of terminals that would result from a center line deviation between mating terminals.

2. Description of the Prior Art

FIG. 10 is a perspective view of a conventional resilient terminal. The resilient terminal 11 has both sides of the base portion 12 bent toward each other to form a pair of binocular-shaped female contact portions 13*a*, 13*b*. The base portion 12 between the pair of electric contact portions 13*a*, 13*b* is narrowed to form a resilient joint portion 14.

FIG. 11 shows how the resilient terminal is used. The resilient terminal 11 is installed in a joint box 15 in an automobile. One of the electric contact portions 13*b* is connected with a busbar 16, and a tab-shaped male terminal 17 is inserted into the other electric contact portion 13*a*.

When the male terminal 17 is misaligned from the resilient terminal 11, the flexible joint portion 14 is bent as the male terminal 17 is inserted, thus allowing the terminal engagement. However, where the insertion force of the male terminal 17 is large or where said misalignment of the male terminal is excessive, the joint portion 4 which is structurally weak is buckled as shown in FIG. 12, rendering the connection of the two terminals impossible.

SUMMARY OF THE INVENTION

In light of the above problems, it is an object of this invention to provide a resilient terminal which will not buckle even when the insertion force of a mating terminal is large or in the event of excessive misalignment.

To achieve the above objective, this invention provides a resilient terminal with a buckling prevention mechanism, which basically comprises: a pair of electric contact portions arranged in a longitudinal direction, the contact portions being interconnected through a resilient joint portion; and abutments provided to the respective electric contact portions, said abutments being disposed in close facing relation to each other, said abutments lying substantially in a plane perpendicular to said longitudinal direction to face said resilient joint portion.

When an excess force is applied, in the terminal insertion direction, to the resilient terminal with a buckling prevention mechanism, the joint portion deflects until the abutments abut each other to prevent the joint portion from buckling. At the same time, one of the abutments slides on the other to correct the terminal misalignment, allowing reliable terminal engagement.

DESCRIPTION OF THE PREFERRED EMBODIMENTS

A resilient terminal with a buckling prevention mechanism according to this invention will be described.

Figure 1:
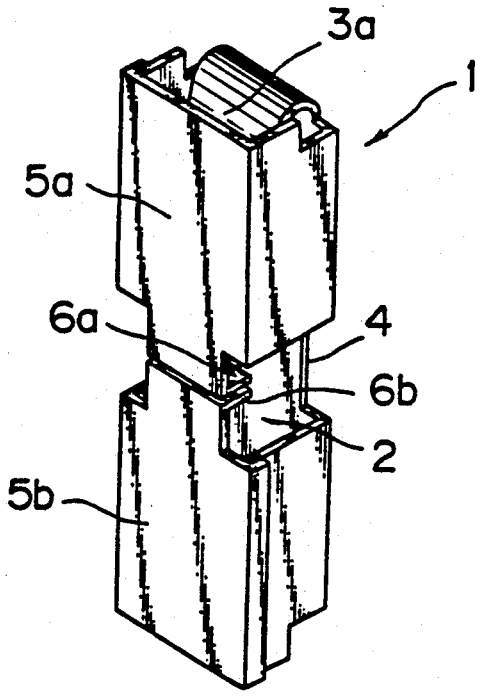
FIG. 1 is a perspective view of a terminal with a buckling prevention mechanism shown as a first embodiment of this invention.
Figure 2:
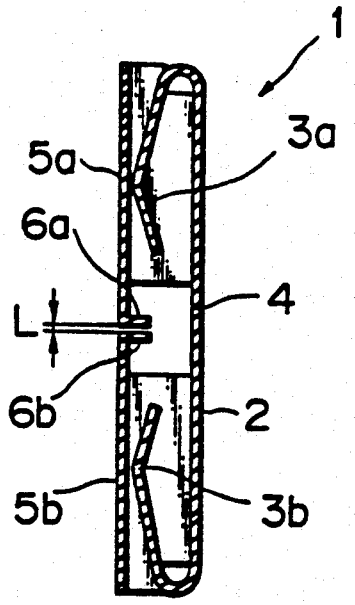
FIG. 2 is a vertical cross section of the first embodiment terminal.

FIG. 1 is a perspective view of the resilient terminal as one embodiment of the invention. FIG. 2 is a cross section of the terminal. The resilient terminal 1 with a buckling prevention mechanism has the ends of its base 2 folded inwardly to form tongue-shaped, resilient, electric contact pieces 3*a*, 3*b*. The central portion (joint portion 4) of the base 2 is narrowed in width to provide the base with resiliency when subjected to a bending force. A pair of terminal accommodating cases (electric contact cases) 5*a*, 5*b* are formed to extend from both sides of the base 2 so that they enclose the pair of electric contact pieces 3*a*, 3*b*. The pair of terminal accommodating cases 5*a*, 5*b* are provided with abutment pieces 6*a*, 6*b* that are disposed in close facing relation to each other. The pair of closely arranged abutment pieces 6*a*, 6*b* are spaced from each other by a gap L, which is small enough for the joint portion 4 to assure the limitation of resiliency when subjected to a bending force. The abutment pieces 6*a*, 6*b* are disposed to lie substantially in a plane perpendicular to said longitudinal direction to face said joint portion 4.

Figure 3:
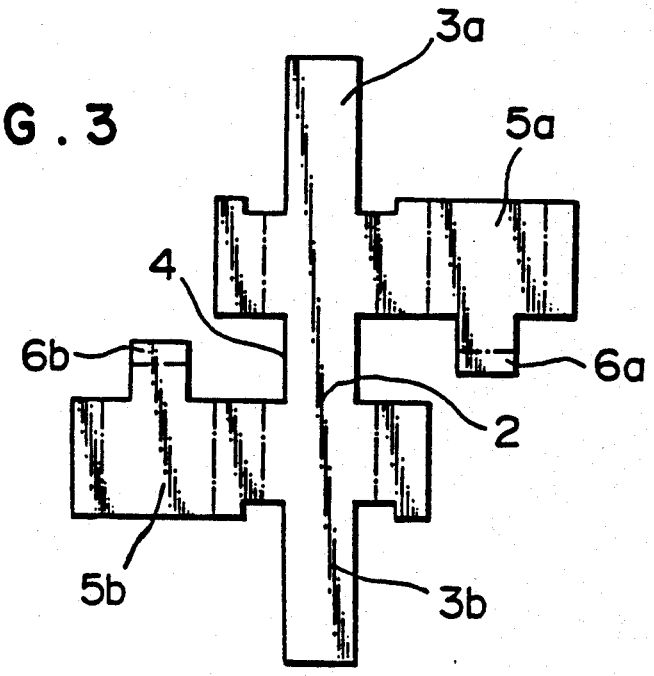
FIG. 3 is a development view of the first embodiment terminal.

FIG. 3 is a development view showing the buckling prevention mechanism-incorporated terminal 1 of FIG. 1 unfolded. A thin conductive metal plate is punched to form the base 2 of a shape as shown. Both longitudinal ends of the punched base 2 constitute electric contact pieces 3*a*, 3*b*; the central portion forms a narrow joint portion 4; and projecting symmetrically laterally at the upper and lower part of the base are those portions that will be formed into the terminal accommodating cases 5*a*, 5*b*. These portions for the terminal accommodating cases 5*a*, 5*b* are provided with inwardly projecting abutment pieces 6*a*, 6*b*.

Figure 4:
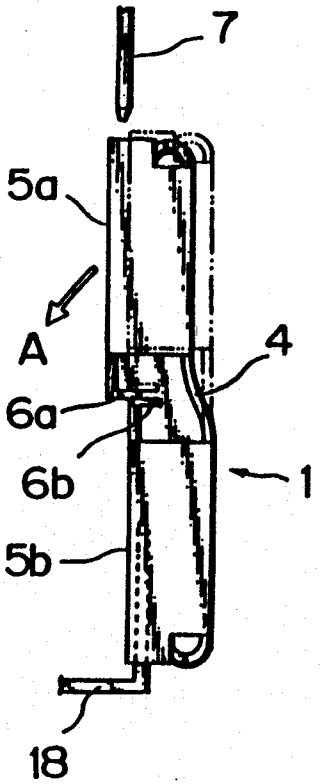
FIG. 4 is a side view showing how the first embodiment terminal works.

FIG. 4 is a side view showing how the resilient terminal 1 with the buckling prevention mechanism described above works. In the figure, reference numeral 7 denotes a tab-shaped male terminal. The resilient terminal 1 with the buckling prevention mechanism, which is installed in a joint box (not shown) and connected to a busbar 18, is greatly off-centered from the male terminal 7, as illustrated by a two-dot line which represents the condition of the resilient terminal before receiving the male terminal 7. In this condition, when the male terminal 7 is inserted, the terminal accommodating case 5*a* is forced by the incoming terminal 7 to rotate in an arc in a direction A about the base end of the resilient joint portion 4 as indicated by the solid line until the abutment pieces 6*a*, 6*b* come into contact with each other. Thus no buckling occurs at the joint portion 4. When the misalignment between the centers of these terminals is large, the abutment piece 6*a* on the male terminal insertion side slides on the other fixed abutment piece 6*b* to correct the center line misalignment.

Figure 6:
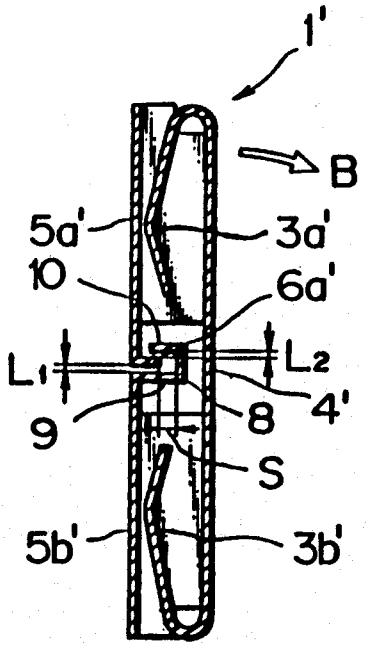
FIG. 6 is a vertical cross section of the second embodiment terminal.
Figure 5:
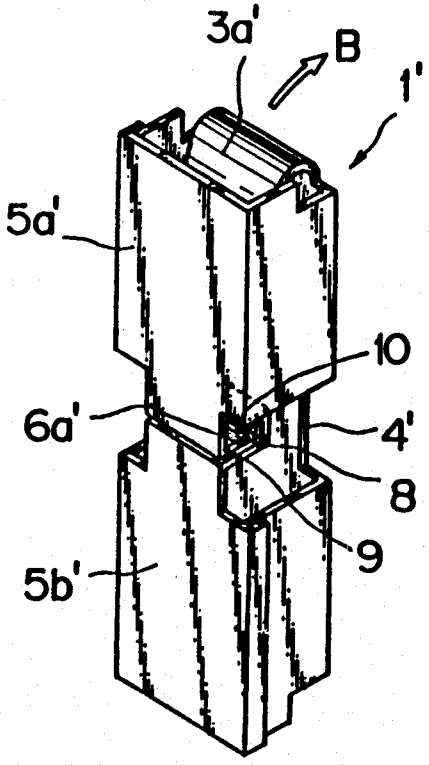
FIG. 5 is a perspective view of a resilient terminal as a second embodiment of the invention.

FIG. 5 is a perspective view of a second embodiment of this invention. FIG. 6 is a crosssectional view of the second embodiment terminal. The resilient terminal 1' with a buckling prevention mechanism has, as in the preceding embodiment, electric contact pieces 3*a'*, 3*b'*, a joint portion 4' and terminal accommodating cases 5*a'*, 5*b'*. The terminal accommodating case 5*a'* on the male terminal insertion side is formed with a flat abutment piece 6*a'* projecting perpendicular with respect to the case 5*a'*. The stationary terminal accommodating case 5*b'* is formed with a U-shaped engagement wall 8 disposed perpendicular to the case 5*b'* so that it encloses the first abutment piece 6*a'*. As in the first embodiment, said abutment 8 is positioned to lie substantially in a plane perpendicular to the longitudinal direction to face the joint portion 4'.

The abutment 8 consists of a push abutment wall 9 and a pull abutment wall 10. The gaps $L_1$, $L_2$ between the engagement piece 6*a'* and the engagement walls 9, 10 are set almost equal. The push abutment wall 9 is formed longer than the abutment piece 6*a'* and the pull abutment wall 10 is formed to partly lap the abutment piece 6*a'*. In other words, a gap S is provided for the terminal accommodating case 5*a'* to move in the direction B. According to this embodiment, therefore, the terminal connection can be made smoothly in whatever direction the male terminal may be deviated.

Figure 10:
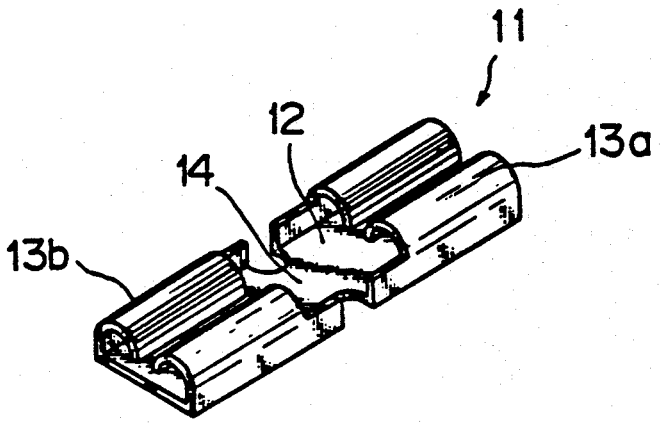
FIG. 10 PRIOR ART
FIG. 10 is a perspective view of a conventional terminal.
Figure 11:
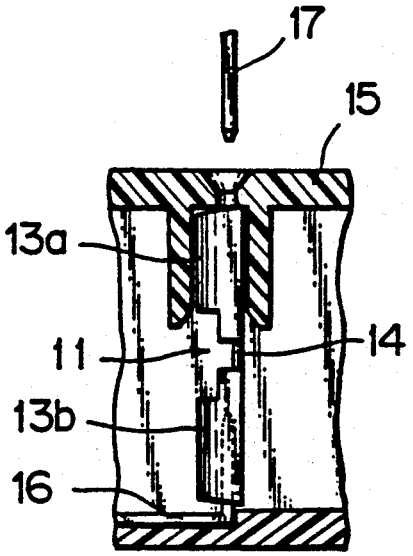
FIG. 11 PRIOR ART
FIGS. 11 and 12 are side views showing how the conventional terminal works.
Figure 12:
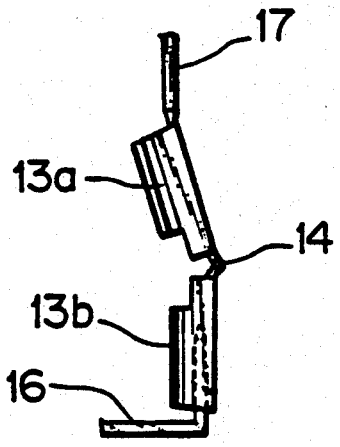
FIG. 12 PRIOR ART

In another embodiment, rather than using the tongue-shaped electric contact pieces 3*a*, 3*b* shown in FIGS. 1 and 2, it is possible to form binocular-shaped electric contact portions 13*a*, 13*b* as shown in the conventional terminal (FIG. 10) and form opposing abutment pieces 6*a*, 6*b* as shown in FIG. 1 on the electric contact portions 13*a*, 13*b*.

Figure 7:
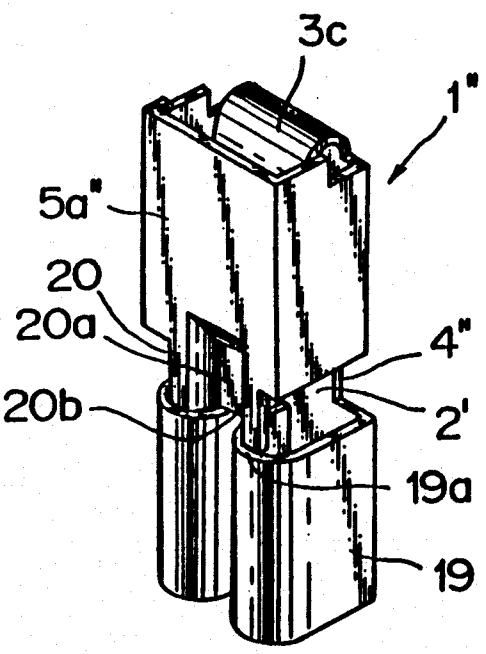
FIG. 7 is a perspective view of a resilient terminal as a third embodiment of the invention.

Furthermore, as shown in FIG. 7, the resilient terminal 1'' with a buckling prevention mechanism may have a tongue-shaped electric contact piece 3*c* at one end and, at the other end, a binocular-shaped electric contact portion 19.

In the resilient terminal 1'', the base 2' is formed with a tongue-shaped electric contact piece 3*c* at one end. At this end it also has a terminal accommodating case 5*a''* that extends from the sides of the base 2' to enclose the contact piece 3*c*. The central portion of the base 2' is made narrow to form a resilient joint portion 4''. At the other end of the base 2' there is formed a binocular-shaped electric contact portion 19 which extends from both sides of the base 2' with side extensions curled toward each other. The terminal accommodating case 5*a''* has an abutment piece 20 formed integral therewith, which is disposed close to and opposite to the end surface 19*a* of the binocular-shaped electric contact portion 19. The abutment piece 20 has an embossed groove 20*a* that extends longitudinally from its end. The embossed groove 20*a* is so formed that its front end surface 20*b* follows the contour of the end surface 19*a* of the curled portion of the electric contact portion 19. This is intended to increase the engagement area and thereby enhance the strength of the abutment piece 20.

Figure 8:
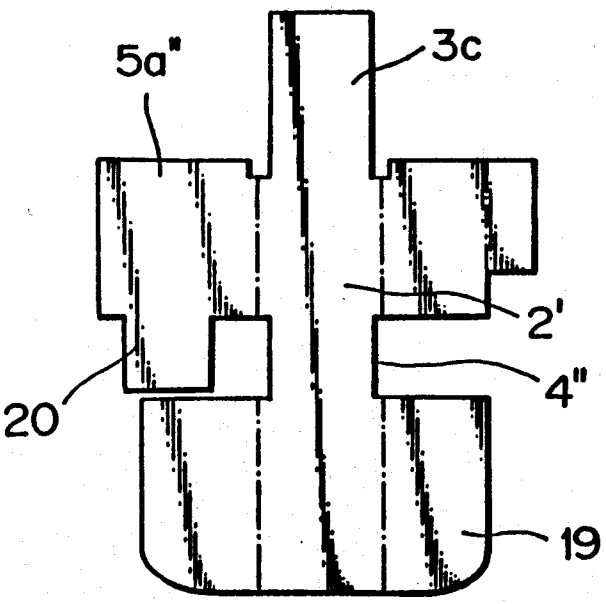
FIG. 8 is a development view of the third embodiment terminal.

FIG. 8 is a development view of the resilient terminal 1'' with a buckling prevention mechanism of FIG. 7. A conductive thin metal plate is punched to form the base 2' as shown. The upper end of the punched base 2' will constitute the tongue-shaped electric contact portion 3*c*. The laterally projecting portion at the middle of the base 2' will be formed into the terminal accommodating case 5*a''*. A portion projecting downwardly from the left side of the case 5*a''* will form the abutment piece 20. The lower part of the base 2', which is connected to the case 5*a''* through the narrow joint portion 4'' at the center, is the one to form the binocular-like electric contact portion 19.

Figure 9:
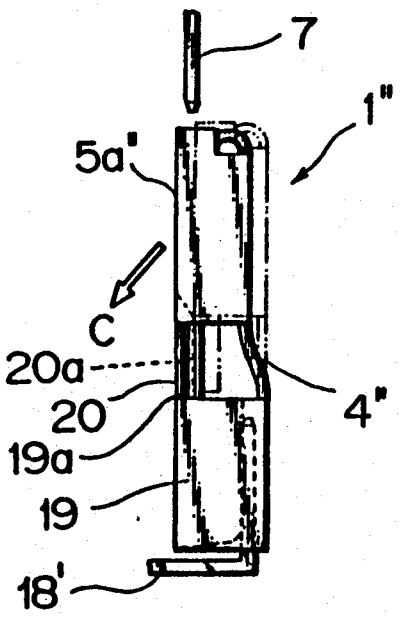
FIG. 9 is a side view showing how the third embodiment terminal works.

FIG. 9 is a side view showing the action of the resilient terminal 1'' that incorporates the buckling prevention mechanism described above. In the figure, reference numeral 7 is a tab-shaped male terminal. The buckling prevention mechanism-incorporated terminal 1'' connected to the busbar 18' is off-centered greatly from the male terminal 7, as indicated by a two-dot line that represents the condition of the terminal 1'' before insertion of the male terminal. In this state, when the male terminal 7 is inserted, the terminal accommodating case 5*a''* is forced to move in the direction C about the base end of the resilient joint portion 4'' as indicated by the solid line until the abutment piece 20 abuts against the end surface 19*a* of the binocular-shaped electric contact portion 19 formed at the lower part of the base 2'. This prevents the buckling of the joint portion 4''. The abutment piece 20 is reinforced by the embossed groove 20*a* and thus will not be deflected.

As mentioned in the foregoing, when the terminal insertion force is large or when a male terminal is wrongly inserted, the resilient terminal according to this invention will not be buckled but ensures a reliable terminal connection, enhancing the connection work efficiency and the reliability of electrical connection.

What is claimed is:

1. A resilient terminal with a buckling prevention mechanism comprising:

a resilient joint portion formed at the middle of a conductive thin plate;

a resilient contact piece formed by folding an end portion of the conductive thin plate on a first side of said resilient joint portion;

a terminal accommodating case extending from a base portion of the conductive thin plate on said first side of the resilient joint portion so as to enclose the resilient contact piece;

a resilient contact portion formed at the other end of the conductive thin plate on a second side of the resilient joint portion, the resilient contact portion being formed by curling toward each other side pieces that extend from both sides of the conductive thin plate at the second end; and an abutment piece formed on said terminal accommodating case, the abutment piece being disposed in very close facing relation to the resilient contact portion to almost touch the resilient contact portion.

2. A resilient terminal with a buckling prevention mechanism comprising:

a conductive thin punched plate composed of an elongate base having first and second longitudinal end sections, a first integral pair of wings and a second integral pair of wings formed in said respective first and second longitudinal end sections;

first and second resilient contact means formed by folding the respective first and second integral pairs of wings to receive external contact means thereinto, said elongate base having a resilient joint portion between said first and second resilient contact means, said first and second resilient contact means defining a gap therebetween; and an abutment piece formed integrally with said first resilient contact means to extend in said gap and disposed in very close facing relation to almost touch the second resilient contact means to provide a rigid support and prevent buckling movement of one of said first and second resilient contact means relative to the other contact means at the time of engagement thereof with a mating terminal, said elongate base having a tongue at least at one of said first and second longitudinal end sections, said tongue being folded to extend into the corresponding resilient contact means.

* * * * *